United States Patent [19]

Warburton, Jr.

[11] 4,336,023

[45] Jun. 22, 1982

[54] FORMALDEHYDE-FREE DURABLE PRESS FINISH FABRICS

[75] Inventor: Charles E. Warburton, Jr., Ambler, Pa.

[73] Assignee: Rohm and Haas Company, Philadelphia, Pa.

[21] Appl. No.: 221,683

[22] Filed: Dec. 30, 1980

[51] Int. Cl.[3] ..... D06M 15/12

[52] U.S. Cl. ..... 8/115.7; 8/116 R; 8/184; 8/188

[58] Field of Search ..... 8/188, 116 R, 115.7, 8/184

[56] References Cited

U.S. PATENT DOCUMENTS

| | | | |
|---|---|---|---|
| 2,209,383 | 7/1940 | Bock | 8/188 |
| 2,475,846 | 7/1949 | Lundberg | 260/561 |
| 2,884,057 | 4/1959 | Wilson et al. | 8/188 |
| 3,194,627 | 7/1965 | Gagarine | 8/116 R |
| 3,418,067 | 12/1968 | Mauldin et al. | 8/183 |
| 3,671,305 | 6/1972 | Brown et al. | 427/393.1 |
| 3,678,098 | 7/1972 | Lewis et al. | 260/89.5 N |
| 3,694,393 | 9/1972 | Lewis et al. | 260/29.6 |
| 4,014,645 | 3/1977 | Chancler et al. | 8/17 |
| 4,108,748 | 8/1978 | Portnoy et al. | 204/159.12 |
| 4,245,992 | 1/1981 | Yamashita et al. | 8/188 |

FOREIGN PATENT DOCUMENTS

| | | | |
|---|---|---|---|
| 39-14642 | 7/1964 | Japan | 8/188 |

OTHER PUBLICATIONS

J. W. Frick et al., *Textile Research J.*, 27, 92 (1957).

R. Steele & C. L. Brown, *Amer. Dyestuff Reptr.*, 45, 525 (1956).

K. Walsh et al., *Textile Research J.*, 39, 1126 (1969).

*Primary Examiner*—Maria Parrish Tungol

*Attorney, Agent, or Firm*—Lester E. Johnson

[57] ABSTRACT

There is disclosed a process for imparting to cellulose or cellulose-containing textile materials durable press properties by treating cellulose or cellulose-containing textile materials by applying to the textile materials a treating composition of (a) about 1–25% by weight, based on dry weight of the material, of an activated water-soluble bisvinyl compound and (b) about 0.2–25% by weight, based on dry weight of material, of (1) a copolymer having a Tg<20° C., said copolymer being produced from a monomer mixture containing (i) about 0.25–99.5% by weight, based on weight of copolymer, of a quaternary monomer obtained by reacting an epihalohydrin having the formula,

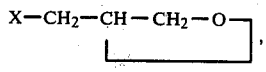

with an ammonium salt having the formula $CH_2{=}C(R)C(O)O\text{-}A\text{-}N(CH_3)_2HY$, wherein R is H or methyl, A is a ($C_2$–$C_6$) alkylene group having at least two carbons in a chain between adjoined O and N atoms or A is a polyoxyethylene group, $(CH_2CH_2O)_nCH_2CH_2$, wherein n is an integer of at least 1, X is iodine, bromine, or chlorine, and Y is an anion, and (ii) at least one copolymerizable ethylenically unsaturated monomer, or (2) the reaction product of a copolymer of said ammonium salt and the epihalohydrin, and (c) sufficient aqueous base solution to effect a pH of about 9–12; drying the treated textile material; and heating the treated textile material at a temperature and for a time sufficient to cure the treating composition.

5 Claims, No Drawings

FORMALDEHYDE-FREE DURABLE PRESS FINISH FABRICS

BACKGROUND OF THE INVENTION

This invention relates to chemical processing of cellulose or cellulose-containing textile materials to form a useful treated textile material having durable press properties, e.g., such properties as wrinkle resistance and wrinkle recovery while retaining the natural properties of the untreated textile materials.

Conventional fabric durable press reagents in present commercial use contain aminoplasts and/or emulsion copolymers containing methylol acrylamide, both of which materials emit formaldehyde upon curing. And, because there is increasing concern resulting from reports in the chemical literature of the toxicity, carcinogenicity, and mutagenicity of formaldehyde, there is an industry-wide need for a formaldehyde-free durable press system.

U.S. Pat. No. 2,475,846 discloses the preparation of activated bisvinyl compounds such as, for example, methylenebisacrylamide. The use of this compound alone for the durable press treatment of cotton is also known as is reported by J. W. Frick et al., *Textile Research J.*, 27, 92 (1957).

U.S. Pat. No. 3,678,098 and related U.S. Pat. No. 3,694,393 disclose the use of the quaternary monomer, or copolymers containing unit of the quaternary monomer, produced by reacting an epihalohydrin with acid salts of a dimethylaminoalkyl (meth)acrylate in making paper and yarn and U.S. Pat. No. 4,014,645 discloses coatings containing the same quaternary monomer and/or copolymers thereof for fabrics. However, these patents do not disclose the use of the quaternary monomers and/or copolymers thereof in durable press treating systems.

The use of conventional polymers for improved crease recovery in fabrics is disclosed by R. Steele and C. L. Browne in *American Dyestuff Reporter*, 45, 525 (1956) and by W. K. Walsh et al. in *Textile Research J.*, 39, 1126 (1969). These disclosures do not mention the use of the quaternary monomer, or copolymers thereof, described above.

U.S. Pat. No. 4,108,748 discloses treating cotton cellulose fabrics with acrylamide solution in a solvent mixture of water and N,N-dimethylformamide and then subjecting the wet impregnated acrylated cotton to ultraviolet light to yield crosslinked durable press cotton fabrics with improved wrinkle recovery angles with minimum losses in breaking strength of the chemically modified cotton fabrics.

DESCRIPTION OF THE INVENTION

It is an object of the invention to provide a process for producing cellulose or cellulose-containing textile materials having improved durable press properties, especially improved wrinkle recovery angles and appearance.

This object, and others as will become apparent, is achieved by the present invention which comprises a process for imparting to cellulose or cellulose-containing textile materials durable press properties by treating cellulose or cellulose-containing textile materials by applying to the textile materials a treating composition of (a) about 1–25% by weight, based on dry weight of the material, of an activated water-soluble bisvinyl compound, and (b) about 0.2–25% by weight, based on dry weight of the material, of (1) a copolymer having a Tg <20° C., said copolymer being produced from a monomer mixture containing (i) about 0.25–99.5% by weight, based on weight of copolymer, of a quaternary monomer produced by reacting an epihalohydrin having the formula,

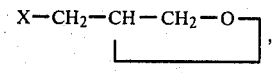

with an ammonium salt having the formula, $CH_2=C(R)C(O)O\text{-}A\text{-}N(CH_3)_2HY$, wherein R is H or methyl, A is a ($C_2$–$C_6$) alkylene group having at least two carbons in a chain between adjoining O and N atoms or A is a polyoxyethylene group, $(CH_2CH_2O)_nCH_2CH_2$, wherein n is an integer of at least 1, X is iodine, bromine, or chlorine, and Y is an anion, and (ii) at least one copolymerizable ethylenically unsaturated monomer, or (2) the reaction product of a copolymer of said ammonium salt and the epihalohydrin, and (c) sufficient aqueous base to effect a pH of about 9–12; drying the treated textile material at a temperature of about 100°–150° C.; and heating the treated textile material at a temperature of about 130°–200° C. for a time sufficient to cure the treating composition.

In another aspect, the invention comprises a chemically-treated cellulose or cellulose-containing textile material produced by the process of the invention.

In accordance with the present invention, a textile treating composition comprising an activated water-soluble bisvinyl compound in combination with, and reacted with, a quaternary monomer containing polymer under alkaline conditions, and then dried and heat-cured has been found to provide advantageous durable press properties in cotton and cotton-containing fabrics.

The activated bisvinyl compound is selected from N,N-methylenebisacrylamide, N,N'-(1,2-dihydroxyethylene) bisacrylamide, diacrylamidoacetic acid, and divinyl sulfone and is used in the amount of 1–25% by weight based on dry untreated textile material. Preferably, the bisvinyl compound is N,N'-methylenebisacrylamide, N,N'-(1,2-dihydroxyethylene) bisacrylamide, or diacrylamidoacetic acid used in the range of amounts of about 3–10% by weight.

The copolymer having a Tg <20° C., said copolymer being produced from a monomer mixture containing (i) said quaternary monomer obtained by reacting said epihalohydrin with the acid salt of the dimethylaminoalkyl (meth)acrylate compound and (ii) said copolymerizable ethylenically unsaturated monomer is disclosed in U.S. Pat. No. 3,678,098 and is the same as disclosed thereiin. The copolymer contains units of the quaternary monomer produced by the reaction of the epihalohydrin

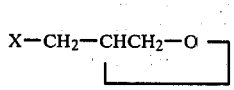

with a hydrogen acid salt of the ester $CH_2=C(R)C(O)O\text{-}A\text{-}N(CH_3)_2HY$ wherein the groups X, R, A, Y and n are as defined above, whether the copolymer is prepared from the quaternary monomer or the copolymer containing units of the hydrogen acid salt ester is reacted with the epihalohydrin. This copolymer component is used in the amount of about 0.2–25% by weight, based on the weight of dry untreated textile material, preferably about 0.5–10% by weight.

As is disclosed in U.S. Pat. No. 3,678,098, the copolymer may contain the quaternary monomer copolymerized with other polymerizable ethylenically unsaturated monomers, especially by emulsion polymerization procedures, including vinyl esters of aliphatic acids, esters of acrylic acid or methacrylic acid, vinyl aromatic hydrocarbons, acrylonitrile and methacrylonitrile, acrylamide and methacrylamide and N-methylol derivatives thereof, to name but a few. Preferably, the copolymer component contains about 1–10% by weight of monomers forming the copolymer of the quaternary monomer and about 99–90% by weight of monomers of a ($C_1$–$C_{18}$) alkyl acrylate.

The copolymer component is activated by treatment with sufficient aqueous base solution to effect a pH of about 9—12. Aqueous solutions containing about 0.25–2% sodium metaborate, sodium tetraborate sodium hydroxide, or sodium bicarbonate are suitable for this purpose.

The following examples illustrate but a few embodiments of the present invention. All parts and percentages are by weight and all temperatures are in degrees Centigrade unless otherwise indicated.

Fabrics used in the examples were (1) 65 Dacron® 54 polyester/35 cotton broadcloth (density = 100 g/m$^2$) (Fabric A), and (2) 50 Dacron® 54 polyester/50 cotton broadcloth (density 187 g/m$^2$) (Fabric B).

The following durable press reagents were used:

MBA = N,N'-methylene bisacrylamide

DHEBA = N,N'-(1,2-dihydroxyethylene) bisacrylamide

DAAA = diacrylamidoacetic acid

Permafresh® 183 and Permafresh® 113B = dimethyloldihydrooxycyclicethyleneurea (DMDHEU) available from Sun Chemical Corp. (used with 3.6% buffered zinc nitrate solution)

Polymer A = 97EA/3 dimethylaminoethylmethacrylate (DMAEMA) quaternized with epichlorohydrin (46% solids)

Polymer B = 97 BA/3 DMAEMA-epichlorohydrin

Polymer C = 92BA/5EA/3 DMAEMA-epichlorohydrin, (Tg = −47° C.)

Polymer D = 97EA/3 DMAEMA-epichlorohydrin (60% solids) (Tg = −16° C.)

EXAMPLE I: Crease Recovery Angles and Durable Press Ratings

This example illustrates the treatment of the Dacron® 54/cotton fabrics with durable press reagents according to the invention and with prior art comparative reagents. Fabrics were saturated with the treatment solution, passed through pad rolls, and fastened to pin frames. The treated fabrics were dried at 110° C./5 min. and cured at 160° C./5 min. in forced draft ovens. They were then removed from the pin frames and washed one cycle or five cycles in an automatic washer with 0.01% Triton X-100 (Rohm and Haas Company) non-ionic surfactant to remove unreacted materials. Add-on of durable press reagent was determined from conditioned (70° F. and 65% relative humidity) weights of fabric before and after treatment.

Wrinkle Recovery Angles (WRA) and Durable Press Appearance (Durable Press Rating) were determined by American Association of Textile Chemists and Colorists (AATCC) Methods 66-1968 and 124-1969, respectively, and the results are set forth in Table I which follows:

TABLE I

CREASE RECOVERY ANGLES AND DURABLE PRESS RATINGS

| Durable Press Reagent (Solids in Bath) | Fabric | Fabric Add-On (%) | WRA (W + F)(°) Cond | WRA (W + F)(°) $H_2O$ | Durable Press Rating 1 Wash | Durable Press Rating 5 Washes |
|---|---|---|---|---|---|---|
| Water (Control) | A | — | 270 | 259 | 3.1 | 2.6 |
| 8.1% Permafresh 113B | A | 3.3 | 292 | 267 | 3.5 | 3.4 |
| 8.1% Permafresh 183 | A | 4.3 | 301 | 279 | 3.5 | 3.2 |
| 5% MBA (1% NaOH) | A | 0.9 | 290 | 270 | 3.2 | 2.7 |
| 5% Polymer A (1% NaOH) | A | 3.9 | 295 | 285 | 3.0 | 3.0 |
| 5% MBA + 5% Polymer A (1% NaOH) | A | 5.6 | 311 | 287 | 3.3 | 3.0 |
| 4% MBA + 5% Polymer A (1% NaOH) | A | 4.5 | 298 | 298 | 3.3 | 2.8 |
| 5% Polymer B (1% NaOH) | A | 3.4 | 304 | 289 | 3.1 | 2.9 |
| 4% MBA + 5% Polymer B (1% NaOH) | A | 4.6 | 305 | 282 | 3.2 | 3.3 |
| 4% DAAA + 2.5% Polymer C | A | 7.2 | 308 | 310 | 3.3 | 3.1 |

The results in Table I show that the use of N,N'-methylenebisacrylamide or diacrylamidoacetic acid with a polymer according to the invention provides improved wrinkle recovery angles and durable press ratings when compared to the use of the components separately.

EXAMPLE II: Effect of Catalyst and Fabric

This example, wherein the fabrics are treated as in Example I above, illustrates the effect of the nature of the catalyst and of the fabric treated. The results in Table II below show that the treatment according to the invention is effective with various base levels and types and fabric composition.

TABLE II

EFFECT OF CATALYST AND FABRIC

| Durable Press Reagent (Solids In Bath) | Catalyst | Fabric | Fabric Add-On | WRA (W&F)(°) Cond | WRA (W&F)(°) Wet | Durable Press Ratings 1 Wash | Durable Press Ratings 5 Washes |
|---|---|---|---|---|---|---|---|
| 4% MBA + 2.5% Polymer C + 0.75% Triton® QS-15 | 2% $NaHCO_3$ | A | 1.7 | 307 | 288 | 3.2 | 3.1 |
| 4% MBA + 2.5% Polymer C + 0.75% Triton® QS-15 | 2% $NaHCO_3$ | B | 2.0 | 288 | 276 | 3.2 | 3.3 |

TABLE II-continued

| Durable Press Reagent (Solids In Bath) | EFFECT OF CATALYST AND FABRIC Catalyst | Fabric | Fabric Add-On | WRA (W&F)(°) Cond | Wet | Durable Press Ratings 1 Wash | 5 Washes |
|---|---|---|---|---|---|---|---|
| 4% MBA + 2.5% Polymer C + 0.75% Triton® QS-15 | 1% $NaHCO_3$ | A | 1.7 | 298 | 291 | 3.3 | 3.3 |
| 4% MBA + 2.5% Polymer C + 0.75% Triton® QS-15 | 1% $NaHCO_3$ | B | 1.8 | 284 | 279 | 3.0 | 3.2 |
| 4% MBA + 2.5% Polymer C + 0.75% Triton® QS-15 | 0.25% NaOH | A | 1.8 | 300 | 283 | 3.3 | 3.1 |
| 4% MBA + 2.5% Polymer C + 0.75% Triton® QS-15 | 0.25% NaOH | B | 2.3 | 293 | 275 | 3.1 | 3.2 |
| 4% MBA + 2.5% Polymer C + 0.75% Triton® QS-15 | 0.1% NaOH | A | 1.9 | 295 | 271 | 3.3 | 3.1 |
| 4% MBA + 5% Polymer A | 1% benzyl trimethyl ammonium OH | A | 5.2 | 300 | 285 | 3.3 | 3.0 |
| 4% MBA + 5% Polymer B + 0.75% Rockmart RC-160® | 0.25% NaOH | A | 5.0 | 298 | 288 | 3.2 | 3.2 |
| 4% MBA + 5% Polymer B + 0.75% Rockmart RC-160® | 0.25% NaOH | B | 5.6 | 282 | 266 | 3.3 | 3.2 |
| 8.1% Permafresh 183 | 0.9% X-4 | B | 3.9 | 277 | 252 | 3.6 | 3.5 |
| 4% DHEBA + 2.5% Polymer C + 0.75% Triton QS-15® | 2% $NaHCO_3$ | A | 2.2 | 308 | 301 | 3.3 | 3.4 |
| 4% DHEBA + 2.5% Polymer C + 0.75% Triton QS-15® | 2% $NaHCO_3$ | B | 2.0 | 300 | 295 | 3.2 | 3.3 |
| 5% DHEBA + 2.5% Polymer C + 0.75% Triton QS-15® | 2% $NaHCO_3$ | A | 2.7 | 307 | 297 | 3.4 | 3.3 |
| 5% DHEBA + 2.5% Polymer C + 0.75% Triton QS-15® | 2% $NaHCO_3$ | B | 2.1 | 293 | 284 | 3.2 | 3.3 |
| Water (Control) | — | B | — | 230 | 234 | 2.6 | 2.1 |

What is claimed is:

1. A process for imparting to cellulose or cellulose-containing textile materials durable press properties by treating cellulose or cellulose-containing textile materials by applying to the textile materials a treating composition of (a) about 1–25% by weight, based on dry weight of the material, of an activated water-soluble bis-vinyl compound, and (b) about 0.2–25% by weight, based on dry weight of the material, of (1) a copolymer having a Tg<20° C., said copolymer being produced from a monomer mixture containing (i) about 0.25–99.5% by weight, based on the weight of the copolymer, of a quarternary monomer obtained by reacting an epihalohydrin having the formula:

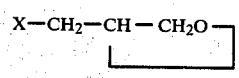

with an ammonium salt having the formula:

$$CH_2{=}C(R)C(O)O\text{-}A\text{-}N(CH_3)_2.HY,$$

wherein R is H or methyl, A is a ($C_2$–$C_6$)alkylene group having at least two carbons in a chain between adjoined O and N atoms or A is a polyoxyethylene group, $(CH_2CH_2O)_nCH_2CH_2$, wherein n is an integer of at least 1, X is iodine, bromine, or chlorine, and Y is an anion, and (ii) at least one copolymerizable ethylenically unsaturated monomer, or (2) the reaction product of a copolymer of said ammonium salt and said epihalohydrin, and (c) sufficient aqueous base to effect a pH of about 9–12; drying the treated textile material at a temperature of about 100°–150° C. and heating the treated textile material at a temperature of about 130°–200° C. for a time sufficient to cure the treating composition.

2. A process according to claim 1 wherein the bisvinyl compound is selected from N,N'-methylenebisacrylamide, diacrylamidoacetic acid, N,N'-(1,2-dihydroxyethylene)bisacrylamide, and divinylsulfone.

3. A process according to claim 1 wherein the textile treating composition comprises (a) about 3–10% by weight, based on the dry material, of a bis-vinyl compound selected from N,N'-methylenebisacrylamide and N,N'-(1,2-dihydroxyethylene)bisacrylamide, (b) 0.5–10% by weight, based on the dry material, of a copolymer produced from a monomer mixture containing about 1–10% by weight of monomer mixture of the quaternary monomer and about 99–90% by weight of monomer mixture of an alkyl acrylate, and (c) about 0.25–2% by weight of aqueous sodium hydroxide.

4. A chemically-treated cellulose or cellulose-containing textile material produced by the process of claim 1.

5. A chemically-treated cellulose or cellulose-containing textile material produced by the process of claim 3.

* * * * *